US006483259B1

(12) United States Patent
Kramer

(10) Patent No.: US 6,483,259 B1
(45) Date of Patent: Nov. 19, 2002

(54) METHOD AND APPARATUS FOR DETERMINING POWER FREQUENCIES THAT CAUSE ARC INSTABILITIES IN DISCHARGE LAMPS

(75) Inventor: Jerry M. Kramer, Yorktown Heights, NY (US)

(73) Assignee: Koninklijke Phillips Electronics N.V., Eindhoven (NL)

( * ) Notice: Subject to any disclaimer, the term of this patent is extended or adjusted under 35 U.S.C. 154(b) by 0 days.

(21) Appl. No.: 09/879,487

(22) Filed: Jun. 12, 2001

(51) Int. Cl.[7] ..... G05F 7/00

(52) U.S. Cl. ..... 315/291; 315/246; 315/307; 315/DIG. 7

(58) Field of Search ..... 315/246, 307, 315/308, 291, 209 R, DIG. 5, DIG. 7, 105

(56) References Cited

U.S. PATENT DOCUMENTS

| | | | | |
|---|---|---|---|---|
| 4,705,991 A | * | 11/1987 | Ganser et al. | 315/194 |
| 5,134,345 A | | 7/1992 | El-Hamamsy et al. | 315/248 |
| 5,198,727 A | | 3/1993 | Allen et al. | 315/291 |
| 5,306,987 A | | 4/1994 | Dakin et al. | 315/248 |
| 5,569,984 A | * | 10/1996 | Holtslag | 315/292 |
| 5,684,367 A | | 11/1997 | Moskowitz et al. | 315/246 |
| 5,859,505 A | * | 1/1999 | Bergman et al. | 315/291 |
| 6,184,633 B1 | | 2/2001 | Kramer | 315/246 |
| 6,229,269 B1 | * | 5/2001 | Olsen | 315/209 R |
| 6,400,100 B1 | * | 6/2002 | Kramer | 315/194 |

* cited by examiner

*Primary Examiner*—Don Wong
*Assistant Examiner*—Ephrem Alemu

(57) ABSTRACT

A method and apparatus for determining which power frequencies applied to a high-intensity discharge lamp cause arc instabilities therein. In one embodiment, the method comprises the steps of providing a current signal that periodically sweeps through a plurality of frequencies during a sweep time period, amplifying the current signal, inputting the amplified current signal into a high intensity discharge lamp so as to effect application of power frequencies to the lamp, determining the power frequencies of the current signal that cause arc instabilities in the high intensity discharge lamp, and determining the minimum power level of the arc instability-producing power frequencies required to cause arc instabilities. In one embodiment, the apparatus comprises a signal generating device that produces a current signal that periodically sweeps through a plurality of frequencies during a sweep time period, an amplifier for amplifying the current signal, means for inputting the amplified current signal into a high intensity discharge lamp so as to effect the application of power frequencies to the lamp, and a signal processing device for determining which of the power frequencies applied to the lamp cause arc instability and the minimum power level of these power frequencies required to cause arc instabilities.

25 Claims, 2 Drawing Sheets

METHOD AND APPARATUS FOR DETERMINING POWER FREQUENCIES THAT CAUSE ARC INSTABILITIES IN DISCHARGE LAMPS

BACKGROUND OF THE INVENTION

1) Field of the Invention

The present invention relates generally to an apparatus and method for analyzing unwanted power frequencies that are generated by pulse width modulation for reducing color segregation in high intensity discharge lamps.

2) Description of Related Art

High intensity discharge lamps (HID) are becoming increasingly popular because of their many advantages, such as high efficacy and brightness. These HID lamps are driven by either a high frequency electronic ballast that is configured to generate driving current signals above the 20 kHz range or by a low frequency electronic ballast with driving current signals in the 100 Hz range.

However, a major obstacle to the use of high frequency electronic ballasts for HID lamps is the acoustic resonances/arc instabilities which can occur at high frequency operation. Acoustic resonances, at many instances, can cause flicker of the arc which is very annoying to humans. Furthermore, acoustic resonance can cause the discharge to extinguish, or even worse, stay permanently deflected against and damage the wall of the discharge lamp. Techniques for stabilizing and centering this arc have been developed. U.S. Pat. No. 5,134,345 teaches the detection of arc instabilities and reducing the power to the lamp to stabilize the discharge. In U.S. Pat. No. 5,306,987, an arc stabilization technique is illustrated in which the frequency of the drive signal is modulated. A similar method of controlling the arc in discharge lamps is illustrated in U.S. Pat. No. 5,198,727. With this method, the arc is centered by the "acoustic perturbations" induced by the frequency modulated HF (high frequency) ripple superimposed on the unidirectional current. The acoustic perturbations compel the gas or vapor movement patterns to counter the gravity-induced convection. U.S. Pat. No. 5,684,367 discloses a method of controlling arc destabilization in HID lamps by amplitude modulation of a high frequency signal and pulsing the lamp, which can be used to change the color characteristics of the lamp.

Recently, a new class of high intensity discharge lamps has been developed that employ ceramic (polycrystalline alumina) envelopes. The discharge envelope in this class of lamps is cylindrical in shape, and the aspect ratio, i.e., the inner length divided by the inner diameter is close to one, or in some instances more than one. The lamps which have an aspect ratio that is significantly greater than one have the desirable property of higher efficacy, but they have the disadvantage of having different color properties in vertical and horizontal operation. In particular, in vertical operation color segregation occurs. The color segregation can be observed by projecting an image of the arc onto a screen, which shows that the bottom part of the arc appears pink, while the top part appears blue or green. This is caused by the absence of complete mixing of the metal additives in the discharge. In the upper part of the discharge there is excessive thallium emission and insufficient sodium emission. This phenomena leads to high color temperature and/or decreased efficacy.

Commonly owned U.S. Pat. No. 6,184,633 entitled Reduction of Vertical Segregation In a Discharge Lamp, incorporated herein by reference, teaches a method to eliminate or substantially reduce acoustic resonance and color segregation by providing a current signal frequency sweep within a sweep time, in combination with an amplitude modulated signal having a frequency referred to as second longitudinal mode frequency. The typical parameters for such operation are a current frequency sweep from 45 to 55 kHz within a sweep time of 10 milliseconds, a constant amplitude modulation frequency of 24.5 kHz and a modulation index of 0.24. For example, in order to excite the $2^{nd}$ longitudinal mode for a 70 W lamp having a 4 mm internal diameter and an inner length of 19 mm, a high frequency sweep from 45 to 55 kHz is amplitude modulated at about 24 kHz. When this waveform is generated by function generators and a power amplifier at low levels of modulation, the resulting power spectrum has frequency components at 24 kHz, 90 kHz to 110 kHz and side bands at 66 kHz to 86 kHz and 114 kHz to 134 kHz. In this ideal power spectrum, there are no power frequency components above about 150 kHz. It is the power frequencies that are important for exciting acoustic resonances.

Another system for reducing color segregation in HID lamps employs a very high frequency ballast bridge (e.g. 250 kHz) having a full-bridge or a half bridge configuration that is controlled by a pulse width modulation (PWM) signal generator. Such a system is shown in commonly owned and copending U.S. patent application Ser. No. 09/684,196, filed Oct. 6, 2000, which is hereby incorporated by reference. In addition to the desired frequency components shown above, this method also produces additional swept power frequencies centered around 200 and 300 kHz and with side bands on both sides of these swept power frequencies. The exact frequencies of the additional swept power frequencies depend on the bridge frequency and are produced from the sum and difference frequency terms of the bridge frequency and high frequency sweep. These additional power frequencies can produce arc instabilities that are not present when the ideal power spectrum is used. Although the ballast bridge frequency can be changed in order to see if the arc instabilities diminish, there are too many frequencies produced by the bridge to identify the offending frequencies. Introducing color mixing also can change the properties of the discharge and therefore change the offending frequencies.

Therefore, what is needed is an independent method and apparatus to identify the offending power frequencies and determine their threshold power level for causing arc instabilities.

SUMMARY OF THE INVENTION

The present invention utilizes frequency sweeping and amplitude modulation or sequential excitation to determine the power frequencies that cause arc instabilities in a high intensity discharge lamp. When a lamp is operated with a sinusoidal waveform at a current frequency X, the power frequency is at 2X. It is the power frequencies that are important for exciting acoustic resonances. The power frequencies applied to the high intensity discharge lamp are determined by the frequency dependence of the product of the current and voltage waveforms at the high intensity discharge lamp.

In one aspect, the present invention is directed to a method for determining which frequencies applied to a high-intensity discharge lamp cause arc instabilities, comprising the steps of (a) providing a signal having frequencies within a predetermined range of frequencies, (b) amplifying the signal, (c) inputting the amplified signal into a high intensity discharge lamp so as to effect application of power frequencies to the lamp, (d) determining if the power frequencies cause arc instabilities in the high intensity discharge lamp, (e) determining a minimum power level of the power frequencies determined in step (d) that is required to cause arc instabilities in the lamp, (e) changing the frequencies of the current signal to other frequencies in the range, and (f) repeating steps (b)–(e).

In one embodiment, the aforementioned providing step (a) comprises the steps of providing a first signal having a predetermined fixed frequency, providing a second signal that is periodically swept over a sweep range from a first frequency to a second frequency during a sweep time period, and summing the first and second signals to produce a sum signal having frequencies that are the sum of the frequencies of the first and second signals. The amplified sum signal is inputted into the high intensity discharge lamp. As a result, power frequencies based upon the sum and difference frequencies of the first and second signals are applied to the high intensity lamp as well as power frequencies at twice the first signal and twice the second signal.

In another aspect, the present invention is directed to a method for determining which frequencies applied to a high-intensity discharge lamp cause arc instabilities, comprising the steps of (a) providing a first signal having a predetermined fixed frequency, (b) providing a second signal that is periodically swept over a sweep range from a first frequency to a second frequency during a sweep time period, (c) summing the first and second signals to produce a sum signal, (d) amplifying the sum signal, (e) inputting the amplified sum signal into a high intensity discharge lamp so as to effect application of power frequencies to the lamp wherein the power frequencies include the sum and difference of the first and second signals, (f) determining if the power frequencies cause arc instabilities in the high intensity discharge lamp, (g) varying the amplitude of the first signal in order to determine the minimum power levels of power frequencies determined in step (f) that are required to cause arc instabilities, and repeating steps (b)–(g) for each fixed frequency required to probe a range of power frequencies.

In a further aspect, the present invention is directed to an apparatus for determining which power frequencies applied to a high-intensity discharge lamp cause arc instabilities, comprising a signal generator that produces a signal that is swept through a plurality of frequencies during a sweep time period, an amplifier for amplifying the signal, means for inputting the amplified signal into a high intensity discharge lamp so as to effect application of a range of power frequencies to the lamp, and a signal processing device for determining (1) the power frequencies applied to the lamp that cause arc instability in the high intensity discharge lamp, and (2) the minimum power level of such power frequencies required to cause arc instabilities. In one embodiment, the signal generator apparatus further comprises a first signal generating device for generating a first signal having a fixed frequency, and a second signal generating device for generating a second signal that is periodically swept over a sweep from a first frequency to a second frequency during a sweep time period, and the apparatus further comprises a summing network for summing the first signal and the second signal to produce a sum signal having frequencies that are the sum of the frequencies of the first and second signals. The amplified sum signal is inputted into the high intensity discharge lamp thereby causing power frequencies based upon the sum and difference of the frequencies of the first and second signals as well as power frequencies at twice the first signal and twice the second signal to be applied to the high intensity lamp.

BRIEF DESCRIPTION OF THE DRAWINGS

The features of the invention are believed to be novel and the elements characteristic of the invention are set forth with particularity in the appended claims. The invention itself, both as to organization and method of operation, may best be understood by reference to the detailed description which follows taken in conjunction with the accompanying drawings in which:

DETAILED DESCRIPTION OF THE PREFERRED EMBODIMENTS

Figure 1:
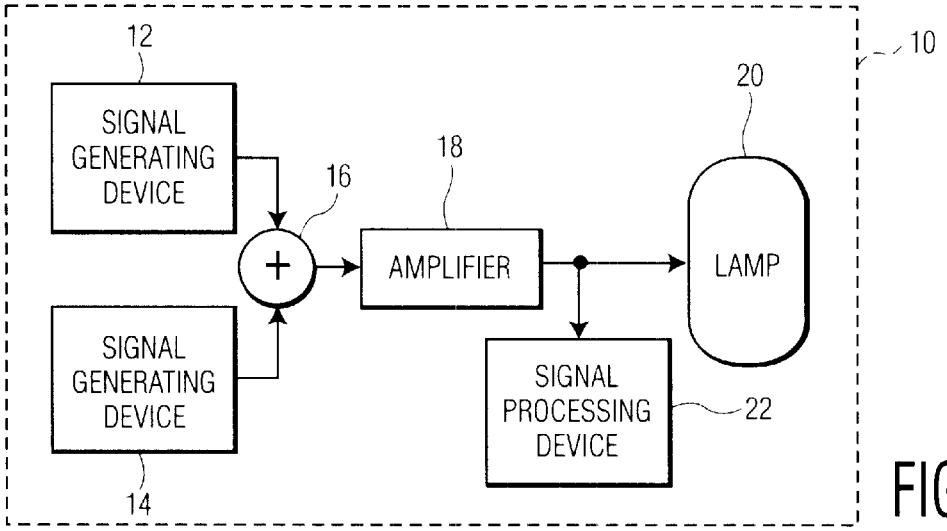
FIG. 1 is a block diagram of one embodiment of the apparatus of the present invention.

Referring to FIG. 1, there is shown one embodiment of the apparatus of the present invention. As will be apparent from the ensuing description, apparatus 10 is configured to generate and control the magnitude of the swept frequencies above about 150 kHz which are generated in the bridge circuit described in commonly owned and copending U.S. patent application Ser. No. 09/684,196 described in the foregoing discussion. Apparatus 10 generally comprises signal generators or signal synthesizers 12 and 14, summing network 16 and amplifier 18. The output of amplifier 18 is coupled to lamp 20. In one embodiment, signal generation modules 12 and 14 are each configured as function generators wherein each function generator has the capability for varying the amplitude and frequency of the signals outputted therefrom.

In accordance with this embodiment of the present invention, function generator 12 is configured to output a current signal Fs that periodically sweeps from a first frequency $Fs_1$ to a second frequency $Fs_2$ in a sweep time period. Thus, frequencies $Fs_1$ and $Fs_2$ define a set or range of frequencies. The term "set", as used herein when referring to the terms "frequency" or "frequencies" is defined as (i) at least one frequency, or (ii) a plurality frequencies that progressively increase from a first frequency to a second frequency that is higher than the first frequency, or (iii) ) a plurality frequencies that do not progressively increase from a first frequency to a second frequency.

Function generator 14 is configured to output a signal having a fixed frequency $F_F$. The output of each function generator 12 and 14 is inputted into summing network 16. Summing network 16 outputs a sum signal equal to $F_F+F_S$ wherein $F_S$ is outputted by function generator 12.

The output of summing network 16 is outputted to amplifier 18. In one embodiment, amplifier 18 is configured as the model 700A1 amplifier manufactured by Amplifier Research. The output of amplifier 18 is applied to lamp 20.

Thus, if the frequency of the current signal outputted by function generator 12 is represented by $F_S$, then the power frequencies seen by lamp 20 are shown in Table I:

TABLE I

| |
|---|
| $2F_S$ |
| $2F_F$ |
| $F_F - F_S$ |
| $F_F + F_S$ |

wherein $F_S$ is in the range defined by $F_{S1}$ and $F_{S2}$.

If fixed frequency $F_F$ is 250 kHz, and frequency $F_s$ is a current frequency sweep wherein $F_{S1}$ is 45 kHz and $F_{S2}$ is 55 kHz, lamp 20 sees the following power frequencies shown in Table II:

TABLE II

| |
|---|
| $2F_S$ = 90 kHz to 100 kHz |
| $2F_F$ = 500 kHz |
| $F_F - F_S$ = 195 kHz to 205 kHz |
| $F_F + F_S$ = 295 kHz to 305 kHz |

The sum ($F_F$+$F_S$) and difference ($F_F$+$F_S$) power frequencies are 10 kHz wide sweeps. Function generator 14 can be controlled to increase or decrease the amplitude of the signal having fixed frequency $F_F$. Increasing or decreasing the amplitude of the fixed frequency $F_F$ varies the amplitude or power level of the sum and difference power frequencies ($F_F$+$F_S$) and difference ($F_F$+$F_S$), respectively, as well as $2F_F$. Varying the fixed frequency $F_F$ shifts the higher swept frequencies.

Apparatus 10 further comprises signal processing device 22 which measures the voltage spectrum applied to lamp 20 as well as the current spectrum of current flowing through lamp 20. Device 22 calculates the power frequency components of the spectrum using a Fourier Transform of the product of the measured voltage and current waveforms. Device 22 can be configured as any of the commercially available programmable network or spectrum analyzers that are capable of performing FFT (Fast Fourier Transform) calculations. A suitable software program for performing FFT calculations is contained in the software program Labview™ manufactured by National Instruments.

In accordance with the present invention, function generator 14 is controlled so as to vary the amplitude and frequency of the signal outputted therefrom in order to induce arc instabilities in lamp 20. Arc instabilities are detected as increases in lamp voltage and/or visual observation. In a preferred embodiment, a fixed frequency $F_F$ is selected that enables the sum and difference frequencies to be distinguished. For example, if a fixed frequency $F_F$ of 150 kHz is chosen and the swept current frequency $F_S$ is swept from 45 kHz to 55 kHz, then the sum frequencies are 10 kHz wide sweeps from 195 kHz to 205 kHz and the difference frequencies are 10 kHz wide sweeps from 95 kHz to 105 kHz. If arc instabilities are detected in lamp 20 when $F_F$ is 150 kHz, then the sum frequencies (195 kHz–205 kHz) are suspect and most likely responsible for the arc instability. However, in order to ascertain that the sum frequencies 195 kHz–205 kHz are responsible for the arc instabilities, fixed frequency $F_F$ is increased to 250 kHz. If the arc instabilities still exists when $F_F$ is 250 kHz, then there is a very high probability that the sum frequencies 195 kHz–205 kHz have caused the arc instabilities.

After frequency regions are found that produce arc instabilities in lamp 20, signal processing device 22 measures the voltage and current spectrums as previously described in the foregoing description. Processing device 22 then determines the power spectrum of the power applied to lamp 20. As a result of the measurement of the power spectrum, threshold power levels for power frequencies causing the arc instabilities are determined and are used to define power level criteria for use in designing ballast bridge circuits and other power circuitry. For example, if a range of fixed frequencies is utilized and processing device 22 determines that the minimum required power level for producing arc instabilities is 0.6 watts at one of these fixed frequencies, then the power threshold is defined as 0.6 watts. As a result, a design criteria based on ½ of the threshold, or 0.3 watts, can be used to design ballast bridge circuitry. In such an example, the power level of frequencies above 150 kHz should not exceed 0.3 watts.

An important feature of apparatus 10 is that it can simulate the swept frequencies generated in a bridge circuit without color mixing.

Figure 2:
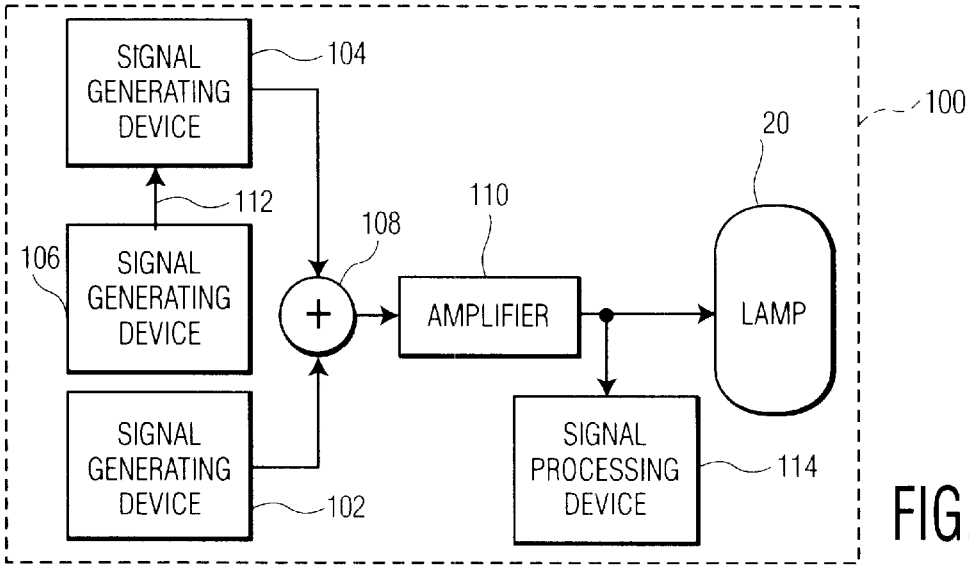
FIG. 2 is a block diagram of another embodiment of the apparatus of the present invention.

Referring to FIG. 2, there is shown a second embodiment of the apparatus of the present invention. Apparatus 100 is configured to determine the frequency regions that cause arc instabilities when color mixing is introduced into lamp 20. Apparatus 100 generally comprises signal generating devices synthesizer 102, 104 and 106, summing network 108 and amplifier 110. In one embodiment, signal generating device 102 is configured as a function generator. Function generator 102 is configured to output a current signal having a fixed frequency $F_F$ in the same manner as function generator 14 described in the foregoing description. Function generator 104 is configured to output a current frequency that periodically sweeps from a first frequency $F_{S1}$, to a second frequency $F_{S2}$ over a sweep time in the same manner as function generator 12 described in the foregoing description. Function generator 104 further includes an input for receiving an amplitude modulating signal 112 having a frequency referred to as a second longitudinal mode frequency. Specifically, signal 112 amplitude modulates the current frequency sweep outputted by function generator 104. Function generator 106 is configured to generate signal 112. Thus, the frequency swept signal outputted by function generator 104 is amplitude modulated by signal 112. In a preferred embodiment, the amplitude modulation signal 112 provided by generator 106 has a frequency of 24 kHz and a modulation index of 0.24. Such a modulation index is typically used in color mixing and is also described in commonly owned U.S. Pat. No. 6,184,633, the disclosure of which is incorporated herein by reference. The output of function generators 102 and 104 are inputted into summing network 108. Thus, if the frequency swept signal is swept from 45 kHz to 55 kHz, and fixed frequency $F_F$ is 250 kHz, amplitude modulation of the frequency swept signal produces a power frequency distribution that comprises 20 kHz side bands centered at 76 kHz and 124 kHz (+/−24 kHz from the main sweep centered at 100 kHz) and which exists along with a fixed power frequency at the second longitudinal mode frequency of 24 kHz. The power frequency distribution further comprises side bands 10 kHz wide at +/−24 kHz of the sum and difference frequencies centered at 200 kHz and 300 kHz, both 10 kHz wide. After the frequency regions are found that cause arc instabilities, the threshold power levels are determined via signal processing device 114 in a manner similar to that described in the foregoing description.

Figure 3:
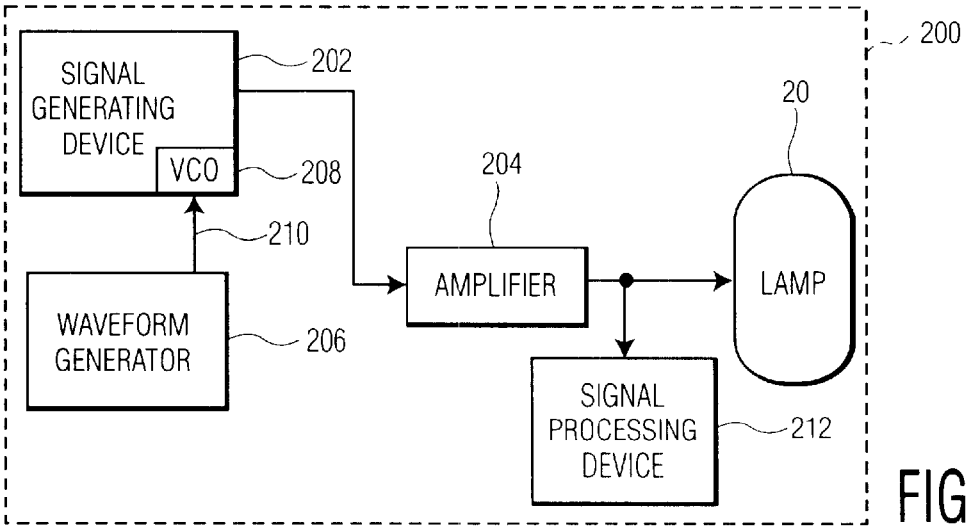
FIG. 3 is a block diagram of a further embodiment of the apparatus of the present invention.
Figure 4:
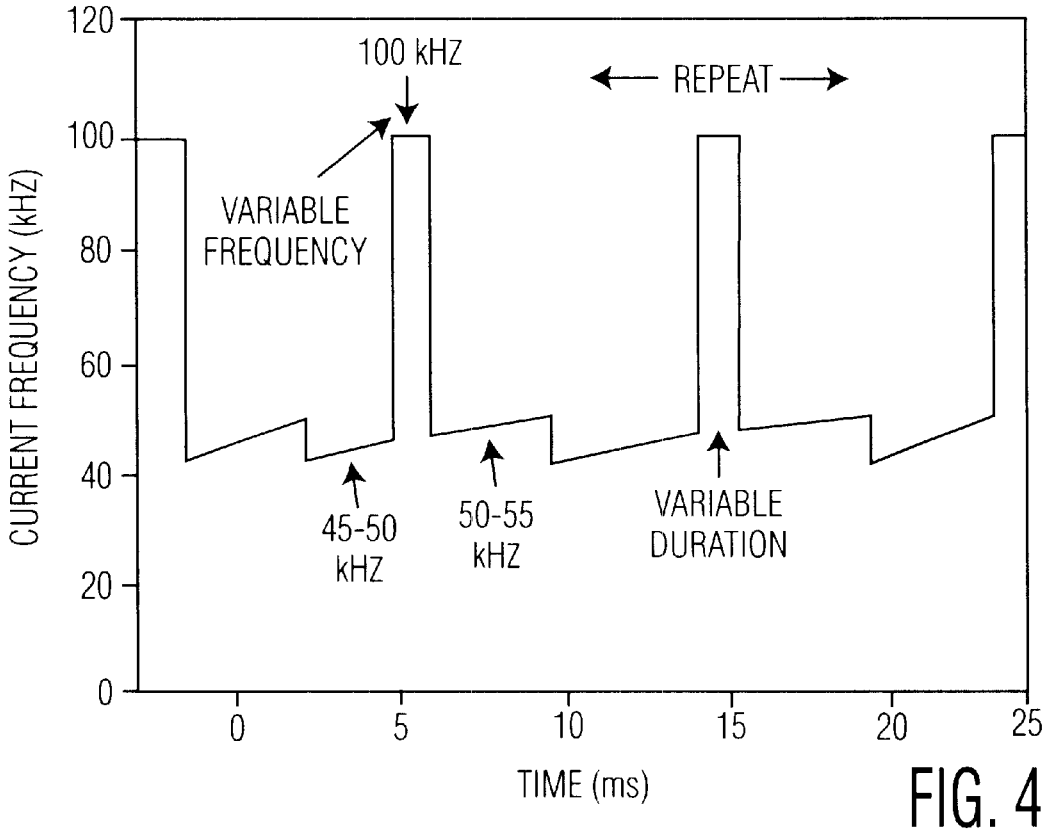
FIG. 4 is a timing diagram illustrating the output of a function generator depicted in FIG. 3.

Referring to FIG. 3, there is shown a further embodiment of the apparatus of the present invention. Apparatus 200 generally comprises signal generator 202, amplifier 204 and waveform generator 206. In one embodiment, signal generator 202 is configured as a function generator having a VCO (voltage controlled oscillator) input 208. Waveform generator 206 is programmable and, in one embodiment, is configured to generate a predetermined voltage waveform 210 that is inputted into VCO input 208 so as to cause function generator 202 to provide a frequency swept signal that sweeps from a first frequency $F_{S1}$, to a second frequency $F_{S2}$ with an additional variable frequency $F_V$). This frequency sweep is variable in time. In one embodiment, the frequency swept signal sweeps from 45 kHz to 55 kHz over a sweep time period of 9.0 ms, and the additional signal frequency $F_V$ is 100 kHz and has a duration of 1.0 ms (millisecond). When apparatus 200 is configured as such, the frequencies causing arc instabilities in lamp 20 can be determined before color mixing begins. The duration of the single frequency is adjustable. FIG. 4 is a timing diagram that illustrates the output of function generator 202. The actual power frequencies are twice the frequencies shown in FIG. 4. After the frequency regions are found that cause arc instabilities, the threshold power levels are determined via signal processing device 212 in a manner similar to devices 22 and 114 described in the foregoing description. Although signal frequency $F_V$ is shown to be centered within a frequency sweep of 45 kHz to 55 kHz, it is to be understood that signal frequency $F_V$ can be generated in another portion of the frequency sweep of 45 kHz to 55 kHz. Thus, the generated order of the signal frequency $F_V$ and the frequencies within the sweep range 45 kHz to 55 kHz can be varied.

Figure 5:
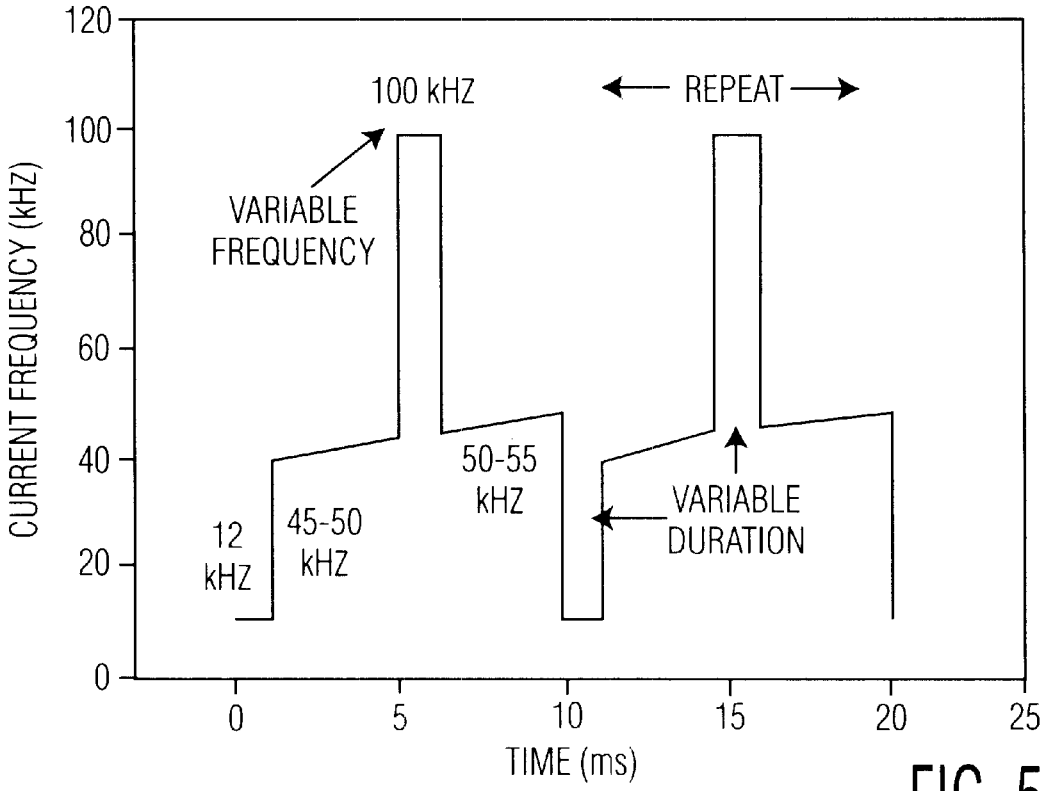
FIG. 5 is a timing diagram illustrating another output of a function generator depicted in FIG. 3

Apparatus 200 also can be utilized to determine arc instabilities as a result of color mixing. In such a configuration, function generator 206 is configured to output a waveform that controls function generator 202 to output a second fixed frequency. In one embodiment, the second fixed frequency is about 12 kHz which is one half of the modulation frequency of 24 kHz previously described in the foregoing description. FIG. 5 illustrates the timing diagram of the signal outputted by function generator 202 in such a configuration. The actual power frequencies are twice the frequencies shown in FIG. 5.

In a further embodiment, waveform generator 206 is configured so as to scan the variable frequency $F_V$. In such an embodiment, variable frequency $F_V$ is scanned from a first frequency to a second frequency in order to effect determination of the power frequencies that cause arc instabilities. For example, the variable frequency $F_V$ can be scanned from about 95 kHz to about 105 kHz while the lamp voltage and current spectrums are measured as described in the foregoing description. This will produce power frequencies from about 190 kHz to about 210 kHz.

The apparatuses and methods of the present invention were used to determine which of the relatively higher ballast bridge circuit frequencies were the cause of arc instabilities in a vertically oriented HID lamp. Separate tests were conducted with and without color mixing. Arc instabilities were detected around 205 kHz (power frequency) without color mixing. Introducing color mixing decreased the power frequencies causing arc instabilities by about 5 kHz to about 10 kHz.

The apparatuses and methods of the present invention were also used to determine which of the relatively higher ballast bridge frequencies were the cause of arc instabilities in a horizontally oriented HID lamp with and without color mixing. In this test, power frequencies of about 195 kHz caused arc instabilities without color mixing. Introducing color mixing in the horizontally oriented lamp decreased the power frequencies causing arc instabilities by the same amount when color mixing is introduced in the vertically oriented burning lamp.

The threshold values for arc instabilities in the horizontally oriented lamp were at about one half of the threshold power level values associated with the vertically oriented lamp.

Theoretical predictions of acoustic resonance frequencies are not suited for predicting frequencies that produce arc instabilities. When based upon the frequency of the first azimuthal mode, the $1^{st}$ azimuthal/$1^{st}$ radial mode is about 182 kHz (power frequency), and the next higher radial or azimuthal mode is the $5^{th}$ azimuthal mode at about 220 kHz (power frequency). Thus, the arc instabilities around 200 kHz power frequency cannot be assigned to a particular resonance. However, the present invention eliminates the effects of the deficiencies associated with and the need for theoretical predictions.

Although particular components or devices have been described in the foregoing description, it is to be understood that suitable substitutions and/or modifications can be made. It should be understood that all such variations, and all other variations which readily occur to those skilled in the pertinent art, are considered to be within the scope of the present invention.

Thus, the method and apparatus of the present invention provide a novel approach to determining the relatively high ballast bridge circuit frequencies that cause arc instabilities in HID lamps and the threshold power values associated with those frequencies. The threshold power level values are used to formulate circuit design criteria and allow for the design of HID lamp products that do not exhibit arc instabilities. The apparatus of the present invention is relatively simple in design and can be implemented with commercially available components. Furthermore, the apparatus and method of the present invention can be implemented at relatively low costs.

The principals, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

Thus, what is claimed is:

1. A method for determining which power frequencies applied to a high-intensity discharge lamp cause arc instabilities therein, comprising the steps of:

a) generating a current signal having frequencies within a predetermined range of frequencies, said range of frequencies comprising a plurality of frequencies;

b) amplifying the current signal;

c) inputting the amplified current signal into a high intensity discharge lamp so as to cause a plurality of power frequencies to be applied to the lamp;

d) determining if the power frequencies cause arc instabilities in the high intensity discharge lamp;

e) determining a minimum power level of the power frequencies determined in step (d) that is required in order to cause arc instabilities in the lamp;

f) varying the frequencies of the current signal; and g) repeating steps (b)–(f).

2. The method according to claim 1 wherein generating step (a) further comprises the steps of:

providing a first current signal having a predetermined fixed frequency;

providing a second current signal that periodically sweeps from a first frequency to a second frequency during a sweep time period;

summing the first and second current signals to produce a sum current signal, the sum current signal defining the current signal that is amplified in amplifying step (b), the sum current signal effecting the application of sum and difference power frequencies to the lamp; and wherein determining step (d) comprises the step of determining the sum and difference power frequencies that cause arc instability in the high intensity discharge lamp.

3. The method according to claim 2 wherein determining step (e) comprises the step of varying the amplitude of the first current signal so as to vary the power level of the sum and difference power frequencies applied to the lamp.

4. The method according to claim 1 wherein determining step (e) comprises the steps of:

measuring the voltage waveform representing the voltage applied to the lamp;

measuring the current waveform representing the current flowing through the lamp;

determining the product of the measured voltage and current waveforms; and performing a Fourier Transform of the product.

5. The method according to claim 2 wherein varying step (f) comprises the step of varying the frequency of the first current signal.

6. The method according to claim 2 further comprising the steps of:

providing a modulating frequency at the power frequency of the second longitudinal mode; and amplitude modulating the second current signal with the modulating frequency to effect color mixing in the lamp.

7. The method according to claim 1 wherein the plurality of frequencies comprises a first frequency set, a second frequency set and a third frequency set.

8. The method according to claim 7 wherein the current signal is first swept through the first frequency set, then the second frequency set, and thereafter the third frequency set.

9. The method according to claim 8 wherein the second frequency set comprises a single frequency that is greater than any of the frequencies in the first and third frequency sets.

10. The method according to claim 9 wherein the first frequency set comprises a range of frequencies that progressively increases from a first frequency to a second frequency that is greater than the first frequency, and the third frequency set comprises a range of frequencies that progressively increases from said second frequency to a third frequency that is greater than said second frequency.

11. The method according to claim 7 wherein the first frequency set comprises a range of frequencies that progressively increases from a first frequency to a second frequency that is greater than the first frequency, the second frequency set comprises a range of frequencies that progressively increases from a third frequency to a fourth frequency that is greater than the third frequency, and the third frequency set comprises a range of frequencies that progressively increases from said second frequency to a fifth frequency that is greater than said second frequency, the third and fourth frequencies being greater than the first, second and fifth frequencies.

12. The method according to claim 7 wherein the first frequency set comprises a range of frequencies that progressively increases from a first frequency to a second frequency that is greater than the first frequency, the second frequency set comprises a range of frequencies that progressively increases from a third frequency to a fourth frequency that is greater than the third frequency, and the third frequency set comprises a range of frequencies that progressively increases from said second frequency to a fifth frequency that is greater than said second frequency, the plurality of frequencies further including a fourth set of frequencies, the fourth set of frequencies comprising a single fixed frequency at one half the power frequency of the second longitudinal mode, the third and fourth frequencies being greater than the first, second, fifth and single fixed frequencies, the single fixed frequency being less than the first, second, third, fourth and fifth frequencies.

13. A method for determining which power frequencies applied to a high-intensity discharge lamp cause arc instabilities therein, comprising the steps of:

a) providing a first current signal having a predetermined fixed frequency;

b) providing a second current signal that is periodically swept from a first frequency to a second frequency during a sweep time period; and c) summing the first and second current frequencies to produce a sum current signal;

d) amplifying the sum current signal;

e) inputting the amplified sum current signal into a high intensity discharge lamp so as to produce sum and difference power frequencies in the lamp;

f) determining if any of the power frequencies cause arc instabilities in the high intensity discharge lamp; and g) varying the amplitude of the first current signal in order to determine a minimum power level of the sum and difference power frequencies determined in step (f) that is required to cause arc instabilities.

14. The method according to claim 13 further including the steps of:

providing a modulating frequency at the power frequency of the second longitudinal mode; and amplitude modulating the second current signal with the modulating frequency to effect color mixing in the lamp.

15. An apparatus for determining which power frequencies applied to a high-intensity discharge lamp cause arc instabilities therein, comprising:

means for producing a current signal having frequencies that are within a range of frequencies, said range of frequencies comprising a plurality of frequencies;

an amplifier for amplifying the current signal;

means for inputting the amplified signal into a high intensity discharge lamp so as to effect application of power frequencies to the lamp;

means for determining if the power frequencies cause arc instabilities in the high intensity discharge lamp;

means for determining a minimum power level of power frequencies that is required to cause arc instabilities in the lamp; and means for varying the frequencies of the current signal.

16. The apparatus according to claim 15 wherein the producing means comprises:

means for generating a first current signal having a fixed frequency;

means for generating a second current signal that is periodically swept from a first frequency to a second frequency during a sweep time period; and the apparatus further comprising a summing network for summing the first and second current signals to produce a sum current signal, the sum current signal defining the current signal inputted into the amplifier.

17. The apparatus according to claim 15 further comprising means for varying the amplitude of the first current signal.

18. The apparatus according to claim 15 further comprising means for varying the frequency of the first current signal.

19. The apparatus according to claim 15 further comprising:

means for providing a modulating frequency at the power frequency of the second longitudinal mode; and means for amplitude modulating the second current signal with the modulating frequency to effect color mixing in the lamp.

20. The apparatus according to claim 15 wherein the plurality of frequencies comprises a first frequency set, a second frequency set and a third frequency set.

21. The apparatus according to claim 20 wherein the current signal is first swept through the first frequency set, then the second frequency set, and thereafter the third frequency set.

22. The apparatus according to claim 21 wherein the second frequency set comprises a single frequency that is greater than any of the frequencies in the first and second frequency sets.

23. The method according to claim 22 wherein the first frequency set comprises a range of frequencies that progressively increases from a first frequency to a second frequency that is greater than the first frequency, and the third frequency set comprises a range of frequencies that progressively increases from said second frequency to a third frequency that is greater than said second frequency.

24. The apparatus according to claim 20 wherein the first frequency set comprises a range of frequencies that progressively increases from a first frequency to a second frequency that is greater than the first frequency, the second frequency set comprises a range of frequencies that progressively increases from a third frequency to a fourth frequency that is greater than the third frequency, and the third frequency set comprises a range of frequencies that progressively increases from said second frequency to a fifth frequency that is greater than said second frequency, the third and fourth frequencies being greater than the first, second and fifth frequencies.

25. The apparatus according to claim 20 wherein the first frequency set comprises a range of frequencies that progressively increases from a first frequency to a second frequency that is greater than the first frequency, the second frequency set comprises a range of frequencies that progressively increases from a third frequency to a fourth frequency that is greater than the third frequency, and the third frequency set comprises a range of frequencies that progressively increases from said second frequency to a fifth frequency that is greater than said second frequency, the plurality of frequencies further including a fourth set of frequencies, the fourth set of frequencies comprising a single fixed frequency at one half the power frequency of the second longitudinal mode, the third and fourth frequencies being greater than the first, second, fifth and single fixed frequencies, the single fixed frequency being less than the first, second, third, fourth and fifth frequencies.

* * * * *

UNITED STATES PATENT AND TRADEMARK OFFICE

CERTIFICATE OF CORRECTION

PATENT NO. : 6,483,259 B1
DATED : November 19, 2002
INVENTOR(S) : Jerry M. Kramer It is certified that error appears in the above-identified patent and that said Letters Patent is hereby corrected as shown below:

Title page,
Item [73], change "Phillips" to -- Philips --.

Signed and Sealed this

Fifteenth Day of April, 2003

JAMES E. ROGAN
*Director of the United States Patent and Trademark Office*